United States Patent [19]

Parant et al.

[11] Patent Number: 4,800,966

[45] Date of Patent: Jan. 31, 1989

[54] DEVICES FOR DRILLING BRANCHED WELLS

[75] Inventors: Jean-Pierre Parant, Bizanos; Christian Mariotti, Saint-Gaudens; Patrick Rousselet, Jurencon, all of France

[73] Assignee: Societe Nationale Elf Aquitaine (Production), France

[21] Appl. No.: 44,333

[22] Filed: Apr. 30, 1987

[30] Foreign Application Priority Data

Apr. 30, 1986 [FR] France ..... 86 06256

[51] Int. Cl.[4] ..... E21B 7/08

[52] U.S. Cl. ..... 175/73; 175/79; 175/322; 285/302

[58] Field of Search ..... 175/79, 61, 62, 321, 175/322, 73; 285/302; 166/117

[56] References Cited

U.S. PATENT DOCUMENTS

| | | | |
|---|---|---|---|
| 4,007,797 | 2/1977 | Jeter | 175/81 |
| 4,396,075 | 8/1983 | Wood | 175/79 |
| 4,403,654 | 9/1983 | Haynes | 285/302 |
| 4,415,205 | 11/1983 | Rehm et al. | 299/5 |
| 4,444,276 | 4/1984 | Peterson | 175/61 |
| 4,573,541 | 3/1986 | Josse et al. | 175/61 |
| 4,693,316 | 9/1987 | Ringgenberg et al. | 175/321 |
| 4,697,651 | 10/1987 | Dellinger | 175/61 |

FOREIGN PATENT DOCUMENTS

| | | |
|---|---|---|
| 0136935 | 4/1985 | European Pat. Off. . |
| 1114849 | 5/1968 | United Kingdom . |
| 2060804 | 5/1981 | United Kingdom . |

*Primary Examiner*—Stephen J. Novosad
*Assistant Examiner*—Terry L. Melius
*Attorney, Agent, or Firm*—Wegner & Bretschneider

[57] ABSTRACT

A device for drilling lateral boreholes from a cased parent well comprises selecting and coupling means adapted to cooperate with a deflection unit placed within the parent well. The selecting and coupling means are mounted at the lower end of an extension unit formed by interassembled tubular elements. The upper end of the extension unit is rigidly fixed to a suspension swivel within the wellhead and at least one slip joint is interposed between two tubular elements. The internal diameter of each tubular element is such that a drilling packer can be housed within the tubular elements.

11 Claims, 2 Drawing Sheets

DEVICES FOR DRILLING BRANCHED WELLS

BACKGROUND OF THE INVENTION

1. Field of the Invention

The present invention relates to improvements to devices for drilling branched wells, also known as multiple-completion wells.

2. Description of the Prior Art

It has been the practice for a very long time to drill multiple-completion wells which are none other than branch boreholes obtained from a main or parent well.

An elaborate technique of multiple-borehole drilling consists in making use of deflecting means which are usually made up of three deflecting tubes placed at 120° with respect to each other, in lowering them into the parent well and in fixing them in situ. Coupling means are then employed for selecting one of the deflecting tubes from which it is desired to drill a branch line or lateral branch borehole. Devices for carrying out this technique are described in U.S. Pat. Nos. 4,396,075, 4,415,205 and in French Pat. No. 83 13 981.

At least in the U.S. patents cited above, the devices described entail the need to lower the selecting means together with the drilling packer itself. It is consequently necessary in any operation performed within the main well or within one of the branch boreholes of the well, not only to displace the drilling packer but also to displace the selecting means and consequently all their elements and components. This is the case in particular at the time of a change of packer or of a drilling tool which makes it necessary to withdraw the selecting means, to separate them from the drilling packer and then to re-position them on the new drilling packer to be lowered into the well.

Furthermore, positioning in a branch borehole of tools suspended from cables such as well-logging tools is impossible when using the devices described in the U.S. patents cited earlier. It is in fact impossible to re-enter a predetermined branch borehole unless the boreholes are lined with a casing string which extends to the surface.

The aim of the present invention is to overcome the disadvantages mentioned in the foregoing and to propose a device for drilling branched boreholes in which the drilling packer is dissociated from the selecting means which also have a coupling function in French Pat. No. 83 13981.

SUMMARY OF THE INVENTION

An object of the present invention is a device for drilling lateral boreholes from a cased parent well surmounted by a wellhead. This device comprises selecting and coupling means adapted to cooperate with stationarily fixed deflecting means placed within the parent well. The distinctive feature of the invention lies in the fact that the selecting and coupling means are mounted at the lower end of an extension unit formed by tubular elements assembled together, the upper end of said extension unit being rigidly fixed to suspension means placed within the wellhead, at least one slip joint being interposed between two rods of the extension unit, the internal diameter of each rod element of the extension unit being such that a drilling packer can be housed within said elements.

Apart from the possibility which is now offered of performing operations on the drilling packer while maintaining the selecting and coupling means in position, the present invention also permits more effective removal of drill cuttings and debris by virtue of the reduction of the annular space resulting from the use of an extension unit having an internal diameter which is slightly larger than that of the drilling packer.

These and other features of the invention will be more apparent upon consideration of the following description and accompanying drawings.

DETAILED DESCRIPTION OF THE INVENTION

Figure 1:
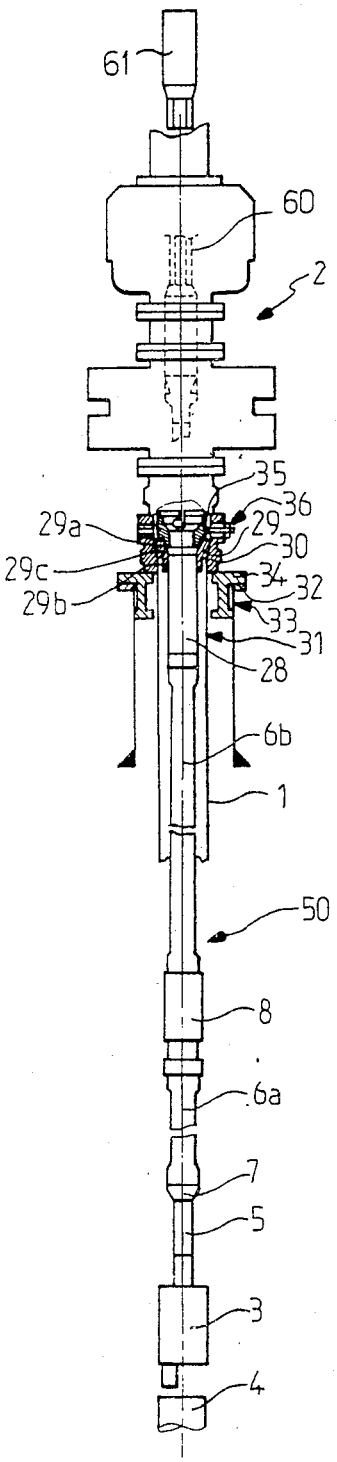
FIG. 1 is a part-sectional view in elevation showing the device in accordance with the invention.

The device in accordance with the invention is intended to be lowered into a suitably equipped wellbore 1 as shown diagrammatically in FIG. 1. The wellbore is surmounted by a wellhead designated by the general reference 2. Only those parts of the wellhead 2 which are included in the device in accordance with the invention are illustrated in partial cross-section for the sake of enhanced clarity of the description which follows hereinafter.

The device comprises selecting and coupling means 3 for cooperating with a deflecting unit 4 shown diagrammatically and stationarily installed within the well by any suitable means as indicated in the patents cited as prior art literature. Similarly the structure of the deflecting unit 4 as well as the selecting and coupling means 3 will not be described here. Reference may usefully be made to the devices described in the prior art in order to obtain information on all the constructional details.

Figure 2:
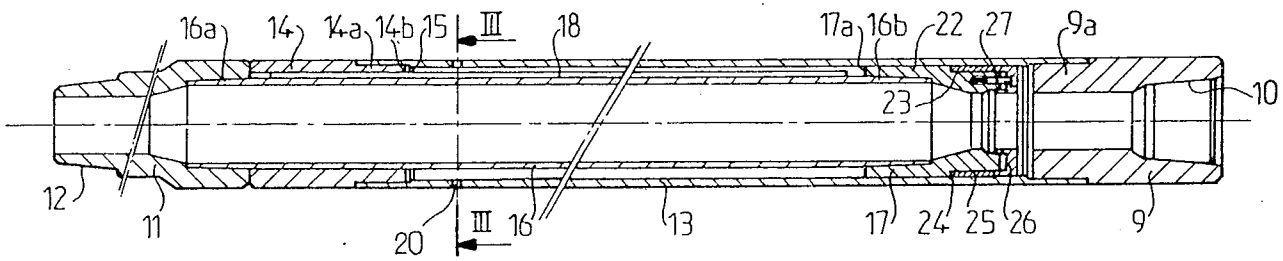
FIG. 2 is a sectional view of the slip joint shown in FIG. 1.

The selecting and coupling means 3 are mounted at the lower end of a tubular element 5. This element can be made up of one or a number of parts as shown in FIG. 1. The element 5 constitutes the lower portion of an extension unit 50 which is constituted by an assembly of tubular elements. The element 5 is intended to endow said extension unit with a certain degree of flexibility in the vicinity of the selecting and coupling means 3 and thus to facilitate coupling of said means 3 with the deflecting unit 4, for example at the time of changeover from one branch borehole to another. The element 5 is coupled to a first group of tubular elements *6a* by means of a union 7 of suitable type in the event of different connections 5 and *6a*. The uppermost element of an assembly of elements *6a* (when a number of elements are connected to each other) is connected to another assembly of tubular elements *6b* by means of a slip joint 8 illustrated in detail in FIGS. 2 and 3.

The slip joint comprises a top union 9 having an internally threaded portion 10 for coupling with a rod *6b* and a bottom union 11 having an externally threaded portion 12 for coupling with a rod *6a*. A portion *9a* of the union 9 is engaged by screwing within one end of a tube 13 having a diameter approximately equal to 24.5 cm, the other end of which is engaged by screwing on a portion *14a* of an intermediate union 14 placed between the tube 13 and the bottom union 11.

Figure 3:
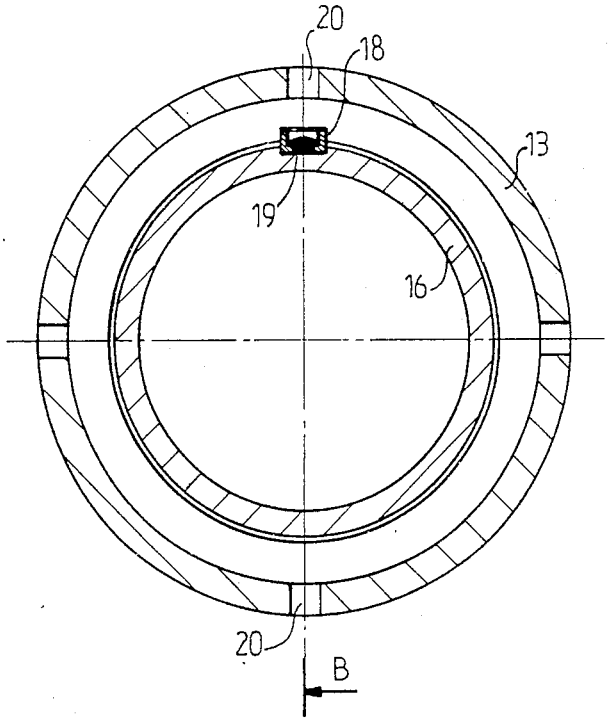
FIG. 3 is a sectional view taken along line III—III of FIG. 2.

An inner tube 16 is housed within the tube 13, one end *16a* of said inner tube being engaged by screwing within the bottom union 11 whilst the other end 16b is engaged by screwing within a piston 17. The inner tube 16 is provided with a guide key 18 which is capable of sliding within a corresponding groove formed in the intermediate union 14, said key 18 being welded on the inner tube 16 by means of a weld fillet 19 (as shown in FIG. 3). At a relatively short distance from the end 14a of the intermediate union 14, one or a number of orifices 20 are formed in the tube 13. The piston 17 has a portion 22 which is capable of sliding along the internal wall of the tube 13 and an annular flange 23 on which are placed a bearing ring 24 and a sealing device 25 which is held in position by a ring 26, said ring being rigidly fixed to the piston 17 by means of screws 27.

The slip joint 8 is shown in the closed state. For expansion of the joint, the bottom union 11 is displaced with respect to the intermediate union 14 which remains stationary since it is rigidly fixed to the outer tube 13. A displacement of the bottom union 11 towards the left produces a displacement of the inner tube 16 and of the piston 17. The maximum displacement is obtained when the free edge 17a of the piston 17 reaches a position close to the end 14b of the portion 14a of the intermediate union 14. This range of travel of the piston 17 makes it possible to adjust the length of the extension unit to the distance which exists between the wellhead 2 and the deflecting unit 4, this adjustment being carried out without any difficulty.

The assembly of elements 6b (shown in FIG. 1) is extended by at least one tube 28 having a sufficiently large internal diameter to permit the engagement of a square or hexagonal kelly 61 in a drilling packer 60 while allowing sufficient clearance for the circulation of drilling mud, limiting impacts between the square kelly and the section 6b of the extension unit and reducing the incidence of a misalignment between the traveling block and the rotary table.

A suspension swivel 29 is mounted in a head 30 which is attached to the upper end of a main casing section 31. The head 30 rests on a flange 32 of a surface casing element 33 by means of a support 34. The suspension swivel 29 has an internally threaded upper portion 29a, an internally threaded lower portion 29b and an intermediate portion 29c. The upper portion 29a is intended to receive a handling rod which is usually provided with a reduction unit in order to lift the assembly consisting of swivel 29 and extension unit 50 to the surface and selecting and coupling means 3. While drilling is in progress, the internal screwthread of the upper portion 29a is protected by a thread protector 35 having two J-shaped recesses or any other suitable system for rapid reconnection at its top portion in order to permit positioning and recovery of this latter. The assembly of thread-protector 35 and suspension swivel 29 is maintained in position within the wellhead by means of cone-point set screws 36.

The elements 5, 6a, 6b and 28 perform the function of a standard extension unit also referred-to by specialists as a riser.

When the selecting and coupling means 3 approach the deflecting unit 4 in order to pass, for example, from one of the inlet orifices to another deflection unit 4, the weight of the device is practically constant. When the coupling means 3 are correctly in position, there is accordingly achieved a reduction in measurable weight at the surface. Positioning of the slip joint at a given level within the extension unit or riser makes it possible to minimize the portion of riser which is subjected to working stress in compression and to place a predetermined weight on said coupling means.

Thus, when a particular branch borehole is selected by the selecting and coupling means 3 within a corresponding orifice of the detecting unit 4, it becomes possible to carry out well-logging and cable measurements on condition that suitable tools for such measurements can be introduced into the different elements of the device in accordance with the invention. Another advantageous consequence is to permit any well control operations such as those which involve checking losses or inflow into the selected branch borehole without any interference with the other boreholes.

In one example of construction of the device in accordance with the invention, the tubular elements 5, 6a, 28 have an internal diameter of 12.7 cm, 16.85 cm, 17.8 cm respectively whereas the tubes 13 and 16 have an internal diameter equal to 24.5 cm and 17.8 cm respectively.

What is claimed is:

1. A device for drilling lateral boreholes from a cased parent well surmounted by a wellhead, and comprising selecting and coupling means adapted to cooperate with stationarily fixed deflecting means placed within the parent well; an extension unit formed by tubular elements assembled together, said selecting means being mounted at the lower end of said extension unit; suspension means placed within the wellhead and to which is rigidly fixed the upper end of said extension unit; at least one slip joint interposed within tubular elements of the extension unit, wherein said slip joint has a means for allowing adjustment of the length of said extension unit between said wellhead and said deflecting means, the internal diameter of each tubular element of said extension unit being such that a drilling packer can be housed within said elements, wherein the suspension means comprises a swivel hanger having a portion of smaller width in which the upper end of the tubular element is mounted and a portion of greater width receives means for pulling to the surface said extension unit, and selecting and coupling means.

2. A device according to claim 1, wherein the extension unit is constituted by tubular elements which usually have different diameters.

3. A device according to claim 2, wherein the tubular element provided at the lower end of the extension unit has a lower degree of rigidity than the remainder of said extension unit.

4. A device according to claim 2, wherein the tubular element is provided at the upper end of the extension unit, the internal diameter and length of said tubular element being sufficient to permit the passage of a kelly.

5. A device according to claim 1, wherein the slip joint is interposed between two groups of tubular elements.

6. A device according to claim 1, wherein the portion of greater width of the suspension swivel is protected by a rapid reconnection means.

7. A device according to claim 1, wherein the protector and the suspension swivel are held in position together within the wellhead by means of cone-point set screws rigidly fixed to the wellhead.

8. A device according to claim 1, wherein the suspension swivel is housed within the head of the main wellhead casing.

9. A device according to claim 5, wherein the slip joint comprises a fixed top union adapted to receive the end of a tubular element, a movable bottom union on which a tubular element can be screwed, a fixed intermediate union interposed between the bottom union and an outer tube to which said intermediate union is screwed at one end, the other end of said tube being screwed on the top union, an inner tube rigidly fixed at one end to the bottom union and at the other end to a piston slidably mounted within the outer tube in leak-tight manner, said inner tube being provided with a guide key, and orifices formed in said outer tube.

10. A device according to claim 6, wherein the portion of greater width of the suspension swivel is protected by a protector having at least two J-shaped recesses.

11. A device as in claim 9, wherein said means for allowing adjustment of the extension unit length comprises a free edge which cooperates with an end portion of said intermediate union.

* * * * *